US005913471A

United States Patent [19]

Makosch et al.

[11] Patent Number: 5,913,471

[45] Date of Patent: Jun. 22, 1999

[54] PAPER WEB CAPTURE DEVICE

[75] Inventors: Manfred Makosch, Königsbrunn; Thomas Meyer, Augsburg, both of Germany

[73] Assignee: MAN Roland Druckmaschinen AG, Offenbach am Main, Germany

[21] Appl. No.: 08/965,732

[22] Filed: Nov. 7, 1997

[30] Foreign Application Priority Data

Nov. 7, 1996 [DE] Germany ..... 196 45 799

[51] Int. Cl.[6] ..... B65H 20/00; B41L 41/00; B41F 13/54

[52] U.S. Cl. ..... 226/186; 101/228; 101/425; 226/193

[58] Field of Search ..... 226/186, 191, 226/193; 101/425, 228

[56] References Cited

U.S. PATENT DOCUMENTS

| | | | |
|---|---|---|---|
| 3,705,451 | 12/1972 | Dahlgren | 101/148 X |
| 4,508,033 | 4/1985 | Fischer . | |
| 4,708,058 | 11/1987 | Smith | 101/147 |
| 5,046,416 | 9/1991 | Freyer et al. . | |
| 5,408,930 | 4/1995 | Loos . | |
| 5,762,000 | 6/1998 | Detmers | 101/425 X |

FOREIGN PATENT DOCUMENTS

| | | |
|---|---|---|
| 0 292 645 | 11/1988 | European Pat. Off. . |
| 0 292 645 A2 | 11/1988 | European Pat. Off. . |
| 0 523 448 A2 | 1/1993 | European Pat. Off. . |
| 687168 | 4/1930 | France . |
| 2 597 794 | 10/1987 | France . |
| 33 09 558 | 9/1984 | Germany . |
| 37 14 143 | 10/1987 | Germany . |
| 44 37 018 | 4/1996 | Germany . |
| 2 241 508 | 9/1991 | United Kingdom . |

*Primary Examiner*—Michael Mansen
*Attorney, Agent, or Firm*—Cohen, Pontani, Lieberman & Pavane

[57] ABSTRACT

A capture device in a printing machine for capturing a printing stock web in the event of a tear in the printing stock web includes two capture cylinders, one of which is movably mounted on a pneumatic piston or other resilient device. The capture device also includes a device for preventing an ink buildup on the capture cylinders. The device for preventing an ink buildup may include washing devices for removing the printing ink deposited on rubber blankets mounted on the outer surface of the capture cylinders. The device to prevent the ink buildup may also include outer surfaces of the cylinders 5, 6 made of an ink-repellent material, such as, for example, chrome. However, the washing devices 12, 13 can also be used in addition to the ink-repellant material.

9 Claims, 1 Drawing Sheet

PAPER WEB CAPTURE DEVICE

BACKGROUND OF THE INVENTION

1. Field of the Invention

The invention relates to a device for preventing printing unit damage in the event of a printing stock web tear in a roll-fed rotary printing machine. The device of the present invention has capture cylinders arranged on both sides of the printing stock web (paper web), which are driven at approximately machine speed and are urged against each other by a resilient member during normal operation as well as in the event of a tear.

2. Description of the Related Art

A prior art device of this type is known from DE 33 09 558 A1. This prior art device discloses the use of two capture cylinders urged against each other on opposing sides of the paper web. In the prior art device, at least one of the two capture cylinders is covered with a rubber blanket for absorbing ink. The capture cylinders, because they are positioned against each other at all times, during both normal operation as well as in the event of a web tear, improve the print quality as follows: After several rotations, the rubber blankets on the capture cylinders become inked in the pattern of the printed image, so that printing ink is re-split from the rubber blankets onto the paper web in keeping with the printed image. As a result, the irregularities in ink coverage that normally occur in the printing units are compensated for during consecutive capture cylinder rotations. The fact that the capture cylinders become inked after several rotations also serves to improve the winding of a torn web around one of the cylinders in the event of a tear in the paper web, because the printing ink that adheres to the cylinders attracts the torn paper web, causing the paper web to cling to the rubber blanket and thereby facilitating reliable winding of the paper web.

A problem with this prior art is that it has been found that some contamination of the paper web still occurs because a buildup of the printing ink adhering to the capture cylinders transfers to the printing stock web.

SUMMARY OF THE INVENTION

It is an object of the present invention to provide a device that prevents printing unit damage resulting from tears in a printing stock web and that minimizes ink contamination of the paper web by minimizing ink buildup on capture cylinders.

To attain the object, the capture device of the present invention is equipped with means for preventing ink buildup on the outer surfaces of two capture cylinders on opposing sides of the paper web. When the outer surfaces of the capture cylinders are covered with rubber blankets, these means comprise a washing device to clean the rubber blankets. The means may also comprise the capture cylinder outer surfaces made of an ink-repellent material, such as chrome. In the latter case, it is also possible to provide a washing device, in addition to the ink-repellant material.

In an advantageous further embodiment of the invention, the capture cylinders rotate such that a surface speed of the capture cylinders is slightly greater than the surface speed of the printing unit cylinders.

The various features of novelty which characterize the invention are pointed out with particularity in the claims annexed to and forming a part of the disclosure. For a better understanding of the invention, its operating advantages, and specific objects attained by its use, reference should be made to the drawing and descriptive matter in which there are illustrated and described preferred embodiments of the invention.

BRIEF DESCRIPTION OF THE DRAWING

An example of the invention is described below in reference to the drawing:

The drawing shows a side view of a capture device for preventing damage to printing units.

DETAILED DESCRIPTION OF THE PRESENTLY PREFERRED EMBODIMENTS

Figure 1:
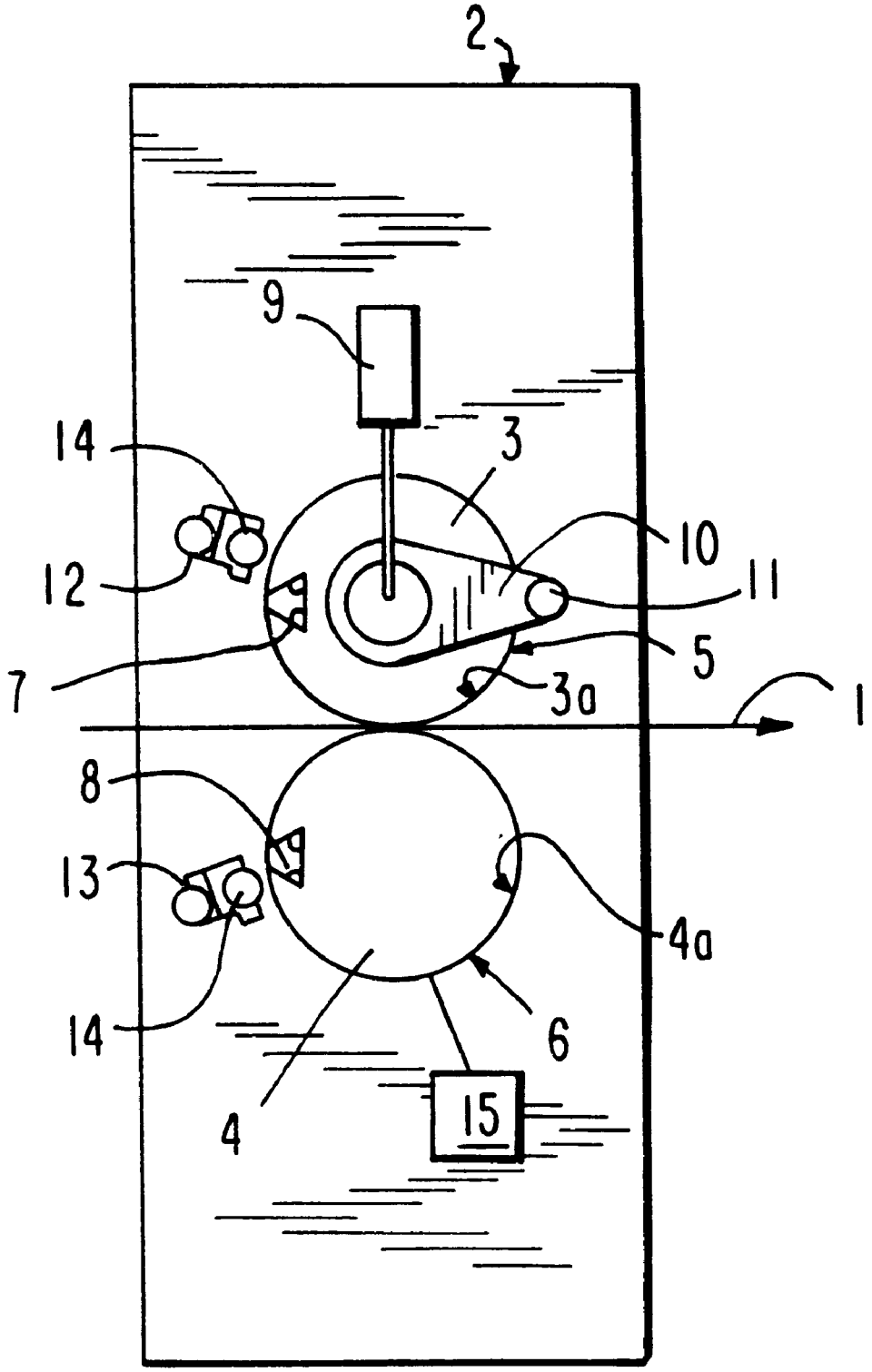

Referring to the Figure, a printing stock web 1, such as a paper web (hereafter referred to as web 1), is printed on one or, preferably, both sides in a printing machine having a printing unit or a plurality of printing units. Upon exiting the final printing unit, the web 1 normally enters a drier and a cooling unit.

A capture device 2 for capturing the web 1 is preferably arranged between the final printing unit, but before the drier.

The capture device 2 includes two capture cylinders 3, 4, arranged respectively on the opposing sides of the web 1 and serve as capture rollers. Each of the capture cylinders 3, 4 is equipped with an ink-compatible cover, such as rubber blankets 5, 6. The rubber blankets 5, 6 are clamped onto the capture cylinders 3, 4, by clamping means 7, 8 arranged in depressions in the capture cylinders 3, 4, like the rubber blankets used in offset printing machines. The capture cylinders 3, 4, can thus have the same structure and size as rubber blankets used in the printing units.

The capture cylinders 3, 4 constantly contact the web 1. A drive device 15 rotates the capture cylinders 3, 4 and maintains a surface speed of the capture cylinders 3, 4 at a speed that is slightly faster (e.g., in the per mil range) than the surface speed of the printing unit cylinders by which the web 1 has been printed. Because of this slightly higher surface speed of the cylinders 3, 4, a pulling effect is applied to the web 1 during normal operation. The pulling effect produces an increased tension of the web 1, which contributes to a more uniform distribution of stress in the printing machine. The slightly increased drive speed of the cylinders 3, 4 is set, however, in such a way that no visible ink streaks or smears appear on the web 1 due to slippage.

The capture cylinders 3, 4 are urged against each other by a resilient member. The lower capture cylinder 4 is mounted in stationary fashion, such as on a conventional eccentric bearing (not shown in the drawing). In contrast, the upper capture cylinder 3 is pressed against the lower capture cylinder 4 with the urging of the resilient member such as a pneumatic piston 9. Thus, when a web tear occurs, the torn web 1 is wound onto either the upper capture cylinder 3 or the lower capture cylinder 4, thereby enlarging the diameter of the cylinder on which it is wound. The position of the upper cylinder 3 deviates upward, due to the enlarged diameter resulting from the winding process. This deviating movement of the upper capture cylinder 3 is made possible by a bearing lever 10, on which the upper capture cylinder 3 is mounted. The bearing lever 10 pivots about its rotational point 11. The upper capture cylinder 3 is thus able deviate, so that no damage occurs to the capture cylinders 3, 4 or their bearings. Alternatively, if there is no bearing lever 10, the axis journals of the upper capture cylinder 3 may also be mounted in sliding pieces, which can be moved within guides in the side wall of the printing machine by pneumatic pistons.

It is true that in the capture device 2, no delay occurs, in the event of a web tear, before the web 1 is wound around the capture cylinders 3, 4. This is because the capture cylinders 3, 4 are always urged against each other.

To prevent an ink layer from building up on the rubber blankets 5, 6 or to remove contamination, the capture cylinders 3, 4 include washing devices 12, 13. The washing devices 12, 13 are constructed like ordinary rubber blanket washing units of the type used to clean rubber blanket cylinders in printing units. Each washing device 12, 13 has, for example, a washing pad or washing cloth 14 that is pressed against the outer surfaces of the capture cylinders 3, 4. The washing cloth 14 is sprayed with a cleaning fluid (not shown in the drawing) and is positioned against the capture cylinders 3, 4 for wiping the surface of the capture cylinders 3, 4. Instead of a washing pad or washing cloth 14, brushes can also be used on the washing devices 12, 13 to clean the outer surfaces of the capture cylinder 3, 4. The washing devices 12, 13 are preferably moved onto the outer surfaces of the capture cylinders 3, 4 to clean them at certain time intervals. However, it is also possible for the washing devices 12, 13 to be fixedly positioned on the outer surfaces of the capture cylinders 3, 4 during the entire printing process.

Instead of being covered with rubber blankets 5, 6, the outer surfaces 3*a*, 4*a* of the cylinders 3, 4 can be made of an ink-repellent material, such as chrome. In this case, it is also possible to use washing devices 12, 13 in addition to using the ink-repellant material.

The invention creates a capture device 2 for capturing a web 1 in the event of a web tear. The capture device 2 has two capture cylinders 3, 4, at least one of which is movably mounted with a pneumatic piston 9. The capture device 2 also includes a means to prevent an ink buildup on the capture cylinders 3, 4. If the capture cylinders 3, 4 are covered with rubber blankets 5, 6, the means to prevent an ink buildup include washing devices 12, 13 to remove the printing ink deposited on the rubber blankets 5, 6. The means to prevent an ink buildup can also include outer surfaces made of an ink-repellant material, such as, for example, chrome. The washing devices 12, 13 can also be used in this case.

The invention is not limited by the embodiments described above which are presented as examples only but can be modified in various ways within the scope of protection defined by the appended patent claims.

We claim:

1. A capture device for preventing printing unit damage resulting from a printing stock web tear in a roll-fed rotary printing machine comprising:

a chassis;

first and second capture cylinders having outer surfaces and mounted in said chassis parallel to each other and on opposing sides of a printing stock web which runs through the capture device, and being operatively mounted on said chassis such that the first capture cylinder is relatively movable toward or away from the second capture cylinder;

a capture cylinder drive operatively connected for driving outer surfaces of said first and second capture cylinders at substantially a speed at which the printing stock web is received from the rotary printing machine;

a resilient member operatively mounted in said chassis for urging said first and second capture cylinders toward each other, wherein the printing stock web is held between said first and second capture cylinders;

the printing stock web being windable about one of said first and second capture cylinders when a tear occurs in the printing stock web, thereby preventing printer unit damage which could otherwise result from the teal; and means for preventing a buildup of ink on the outer surfaces of said first and second capture cylinders, wherein said outer surfaces comprise surfaces of said first and second capture cylinders.

2. The capture device of claim 1, further comprising rubber blankets covering the outer surfaces of said first and second capture cylinders; and said means for preventing a buildup of ink comprising a washing device positioned along the rubber blankets covering the outer surfaces of the first and second capture cylinders.

3. The capture device of claim 2, wherein the washing device is constantly in a position on the rubber blankets on the outer surfaces of said first and second capture cylinders for washing the rubber blankets.

4. The capture device of claim 2, wherein the washing device is intermittently positioned on the rubber blankets on the outer surfaces of said first and second capture cylinders at predetermined time intervals for washing the rubber blankets.

5. The capture device of claim 1, wherein the means for preventing a buildup of ink comprises an outer surface of the first and second cylinders comprising an ink-repellent material.

6. The capture device of claim 5, wherein the ink-repellant material comprises chrome.

7. The capture device of claim 5, further comprising washing devices positioned onto the outer surfaces of said first and second capture cylinders.

8. The capture device of claim 1, wherein a surface speed of the outer surfaces of said first and second capture cylinders is greater than the speed at which the printing stock web is received from the rotary printing machine.

9. The capture device of claim 1, wherein said resilient member comprises a pneumatic piston and the second capture cylinder is mounted on one end of a bearing lever and another end of the bearing lever is pivotably mounted on a rotational point on said chassis.

* * * * *